United States Patent [19]

Elliott

[11] 4,045,167

[45] Aug. 30, 1977

[54] MUFFLED KILN CARS

[75] Inventor: John Elliott, Stoke-on-Trent, England

[73] Assignee: Acme Marls Limited, Stoke-on-Trent, England

[21] Appl. No.: 629,397

[22] Filed: Nov. 6, 1975

[51] Int. Cl.[2] ..... F27D 3/12

[52] U.S. Cl. ..... 432/241; 432/258

[58] Field of Search ..... 432/249, 253, 258, 259, 432/241, 162

[56] References Cited

U.S. PATENT DOCUMENTS

| | | | |
|---|---|---|---|
| 1,336,762 | 4/1920 | Swinnerton | 432/258 |
| 1,642,938 | 9/1927 | Morris | 432/241 |
| 1,832,442 | 11/1931 | Anderson | 432/258 |
| 1,890,978 | 12/1932 | Fear | 432/241 |
| 2,629,917 | 3/1953 | Lovatt | 432/241 |

FOREIGN PATENT DOCUMENTS

| | | | |
|---|---|---|---|
| 695,144 | 8/1953 | United Kingdom | 432/259 |

*Primary Examiner*—John J. Camby
*Assistant Examiner*—Henry C. Yuen
*Attorney, Agent, or Firm*—Woodling, Krost, Granger & Rust

[57] ABSTRACT

The invention is a clip assembly for use in a muffled kiln car suitable for use in a tunnel kiln. The clip assembly enables tall baffle plates to be used without these becoming displaced during travel through the kiln. The assembly includes a swivelable block mounted on the base or shelf of the kiln car and having a groove to receive the corner of the baffle plate. The groove has a tapered forward face having a preferred angle of 27 degrees and a wedge of ceramic material is provided to co-operate with the tapered wall and wedge the base of the baffle plate in position, preventing it from wobbling and becoming displaced or detached.

2 Claims, 3 Drawing Figures

MUFFLED KILN CARS

BACKGROUND OF THE INVENTION

1. Field of the Invention

This invention relates to muffled structures for the firing of ceramic ware. In some types of firing operation it is essential that the ware should be protected from the direct action of the heat source of a kiln in which it is fired, since this would damage the ware.

2. Description of the Prior Art

Muffled kilns have been known for some time but have disadvantages, especially lack of versatility. For example, it is not usually possible to deal with a batch of ware, only some of which needs protecting from the heat source.

When tunnel kilns are used, mobile kiln cars are loaded with ware and passed through the kiln. It has been proposed to muffle the kiln car superstructure by the use of ceramic baffles which enclose some or all of the shelves thereof and which form upright walls secured in place relative to the superstructure.

The superstructure generally includes spaced upright pillars and, in one prior proposal, clips are provided on or adjacent the top and bottom of the pillars and, at a central position between adjacent pillars, a lower clip only is provided level with the bottom of the pillars. It will be appreciated that the pillars support shelves which carry the ware and the lowest rows of pillars are supported on the base of the kiln car, these supporting the lowest shelves and then further pillars are disposed above, resting upon the lowest shelves and so on until the structure has the requisite size.

The baffles used are ceramic plates which can be fitted at the pillars to the upper and lower clips and which are of sizes such that there is sufficient "play" to enable them to be only loosely connected at the pillar clips. This enables the plates to be rocked or "hinged" somewhat at the pillar clips. In general, two plates meet at each central clip which is in the form of a grooved ceramic block, arranged for pivotal movement about a position in which it is aligned with the plates in their aligned, "in use" condition, to catch and release the baffle plates.

Because of the amount of play necessary in the sizing and fitting together of the parts, great problems occur if the space between vertically adjacent shelves is relatively great and the baffles are tall. The baffle plates, being held only loosely, tend to wobble as the kiln car is moved through the kiln and the plates can fall out causing damage to the kiln car superstructure, the ware carried thereon and possibly blockage of or damage to the tunnel kiln.

It is possible to use ceramic pins or pegs passing through portions of the kiln car superstructure such as the shelves into the edges of the baffle plates to hold them securely in place but this arrangement involves the use of extra skilled labour to insert the pins and increases the costs because the pins (being of ceramic material) tend to be brittle and to break. Furthermore, the openings needed to receive the pins tend to weaken the parts in which they are provided and the pins can fall out and mark the ware.

SUMMARY OF THE INVENTION

It is an object of the invention to provide an improved clip assembly for a muffled kiln car enabling tall baffle plates to be used with safety.

According to the invention there is provided a clip assembly for the baffle plate of a muffled kiln car, the assembly comprising a generally rectangular ceramic block having swivel mounting means whereby it can be mounted on a shelf of a kiln car, a groove being defined in the surface of the block remote from said swivel mounting means and having an open mouth for receiving a baffle plate, the groove including a first upright wall perpendicular to said surface and a second wall intersecting said surface at an angle in the range 60° to 70° and inclined away from the upright wall at least adjacent the mouth of the groove, the assembly further comprising a truncated wedge of ceramic material having an apex angle in the range of 20° to 30°, adapted to be inserted between the baffle plate and said second wall.

The invention also contemplates a baffle assembly comprising a baffle plate of ceramic material and a clip assembly therefor, the clip assembly being as set out above, the baffle plate including a generally rectangular cut-out in at least one corner thereof, the cut-out having a height slightly greater than the depth of the block below the base of the groove and the baffle plate being of a thickness slightly less than the width of the groove so as to be capable of engagement within the groove.

BRIEF DESCRIPTION OF THE DRAWINGS

The invention will now be described in more detail by way of example only with reference to the accompanying drawings in which.

DETAILED DESCRIPTION OF THE PREFERRED EMBODIMENT

Figure 1:
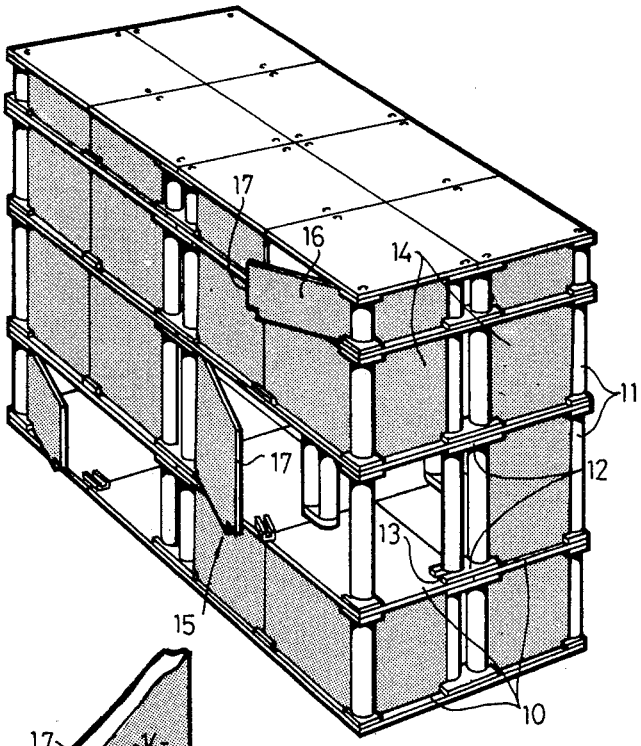
FIG. 1 is a perspective view of a muffled kiln car superstructure.

Referring firstly to FIG. 1, this shows a kiln car superstructure which, in use, will be mounted on the base of a kiln car. The superstructure comprises a plurality of ceramic shelves 10, each of rectangular shape in plan view, together with a plurality of upright pillars 11 which are disposed so as to support successive layers of shelves 10.

Each pillar 11 has a base plate and a top plate 12 which are similar in form. At each end of the base and top plates, there is a deep notch or groove 13, the arrangement being such that the groove of the upper and lower plates are directly one above the other.

Muffles are provided in the form of baffle plates 14 of ceramic material. Each baffle plate is generally rectangular in shape with one corner cut away. This can be seen, for example, at 15 in the drawings. The upright edge of the baffle plate which is remote from the cut-out 15 is perfectly straight and is slotted into the notches 13.

The size of the notches and the thickness of the baffle plate are chosen such that the baffle plate can be rocked outwardly as shown at 16 in the drawings for example. This enables the baffle plates at the sides of the kiln car to be opened and closed, somewhat like doors, in order to insert and withdraw ware from the shelves, without the need to disassemble the entire superstructure.

The free edge of each baffle plate, for example the edge 17, must be secured in position while the kiln car is passing through a tunnel kiln. To this end, the clip assembly shown in FIGS. 2 and 3 of the drawings is provided.

Figure 2:
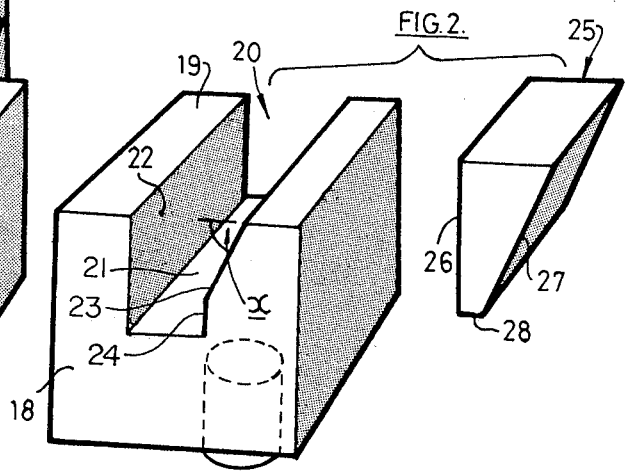
FIG. 2 is an exploded perspective view of a clip assembly embodying the invention.

Referring to FIG. 2, the clip assembly comprises a generally rectangular block 18 which has a swivel mounting at its underside, for example on a pin or the like, shown in FIG. 2, and has its upper surface 19 interrupted by a groove 20 which includes a base 21 parallel to the upper surface 19, a first upright wall 22 perpendicular to the surface 19 and a second wall 23, the top portion of which is inclined away from the wall 22 towards the mouth of the groove 20. The bottom part of the wall 23 is upright as indicated at 24 while the upper part is inclined outwardly so as to meet the surface 19 at an angle $x$ which is between 60° and 70°. Thus, the wall 23 has an inclined part which makes an angle of between 20 and 30 degrees with the vertical.

The assembly also includes a wedge which is made of the same type of ceramic material as the block 18 and which is generally indicated at 25. The wedge 25 includes an upright wall 26, an inclined wall 27 disposed at an angle equivalent to the angle of the wall 23 with the vertical and therefor lying in the range of 20° to 30°. The tip of the wedge is removed so as to leave a truncated edge 28.

Figure 3:
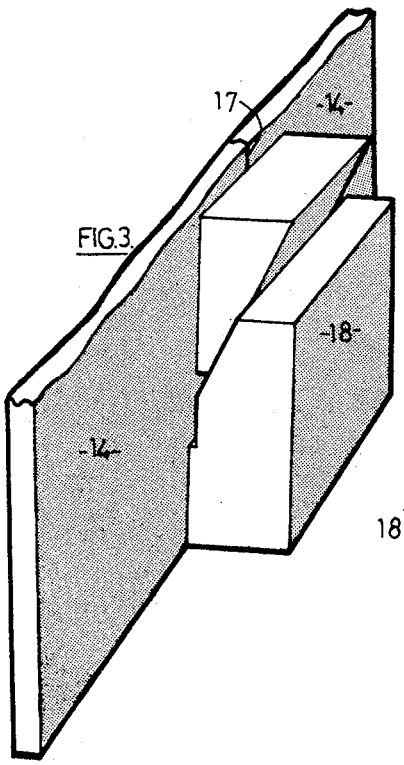
FIG. 3 is a detailed perspective view of the clip assembly in use supporting a pair of baffle plates.

Referring now to FIG. 3 of the drawings, this shows the clip assembly in use in securing the free edges 17 of a pair of baffle plates 14 together to the shelf of a kiln car superstructure (not shown).

The block 18 is pivotally mounted and is positioned so that the inclined wall 23 of the groove is on the outerside and is hence accessible from outside the kiln car. The baffle plates 14 are manipulated into place relative to the clip block 18 so that the cut-outs 15 lodge in the groove 20. The wedge 26 is then pressed downwardly between the inclined wall 23 and the outer surface of the baffle plates until the baffle plates are firmly lodged in position.

It has been ascertained that the best angle for the apex of the wedge is 27° but satisfactory performance is achieved with an angle lying between 20° and 30°. The truncated portion 28 is provided so that the wedge does not have a sharp apex which would tend to break off owing to the brittleness of the material when provided in a shallow unsupported angle.

The angle of 27° is preferable because, if the apex angle is too large, the wedge tends to be forced out by a form of cam action when the parts of the clip assembly pass through a kiln, owing to the high thermal stresses involved in the passage through the high temperature region. If the angle is too small, it is found that the same thermal stresses tend to enable the wedge to become so firmly worked into the groove of the clip that the wedge cannot be removed without breakage.

It will be appreciated that the clip assembly described can be used with both tall and shallow baffle plates but is of greatest utility with tall baffle plates. It can be used to replace a conventional clip and is completely compatible with the existing muffled kiln car system briefly described above.

I claim:

1. A clip assembly for a removable baffle plate of a muffled kiln car with a shelf, said assembly comprising a generally rectangular ceramic block having an upper and an under surface, the block having swivel mounting means provided on the under surface, adapted to swivelably mount the block upon the shelf of the kiln car, the block having a groove defined in its upper surface and adapted to receive the removable baffle plate, said groove being defined by a base and first and second walls, said first wall being upright and perpendicular to said upper surface, said second wall being inclined away from said first wall at least adjacent said upper surface of the block so as to intersect said upper surface at an angle in the range 60° to 70°, the assembly also comprising a truncated wedge of ceramic material having an apex angle in the range 20° to 30° and adapted to be inserted between the removable baffle plate and said second wall of the groove.

2. A clip assembly according to claim 1 wherein the angle of intersection between the second wall and said upper surface of the block is 63° and the apex angle of said wedge is 27°.

* * * * *